US005459926A

United States Patent [19]

Perea

[11] Patent Number: 5,459,926

[45] Date of Patent: Oct. 24, 1995

[54] NAIL CLIPPING AND CATCHING IMPLEMENT AND COLLECTOR ASSEMBLY

[76] Inventor: Chris Perea, 31 King St., Denver, Colo. 80219

[21] Appl. No.: 295,527

[22] Filed: Aug. 24, 1994

[51] Int. Cl.[6] ..... A45D 29/02

[52] U.S. Cl. ..... 30/28; 30/131; 132/75.5

[58] Field of Search ..... 30/26, 28, 124, 30/125, 131; 132/73, 73.5, 75, 75.5, 75.6; 206/37, 581, 823; 220/229; 232/43.1, 43.4; D28/60

[56] References Cited

U.S. PATENT DOCUMENTS

| | | | |
|---|---|---|---|
| 3,722,518 | 3/1973 | Fravel | 132/75.6 |
| 4,341,015 | 7/1982 | Young | 30/28 |
| 4,574,475 | 3/1986 | Lee | 30/28 |
| 4,776,090 | 10/1988 | Grassi | 30/28 |
| 4,956,915 | 9/1990 | Anderson | 30/28 |
| 4,984,366 | 1/1991 | Powers | 30/124 |
| 4,996,771 | 3/1991 | Williams | 30/28 |
| 5,010,644 | 4/1991 | Goench | 30/28 |
| 5,046,606 | 9/1991 | Morelli | 206/37 |
| 5,074,041 | 12/1991 | Wagner | 30/28 |
| 5,150,521 | 9/1992 | Han | 30/28 |
| 5,195,544 | 3/1993 | Campagna | 132/75.5 |
| 5,323,537 | 6/1994 | Ohori | 30/28 |

*Primary Examiner*—Hwei-Sui Payer
*Attorney, Agent, or Firm*—John R. Flanagan

[57] ABSTRACT

A nail clipping and catching implement includes a nail clipper having a forward end portion operable for severing nail fragments from a fingernail and a collector assembly fitted over the forward end portion of the nail clipper for catching and retaining the severed nail fragments. The collector assembly includes a collection receptacle defining an interior collection chamber extending outwardly from cutting edges of the forward end portion of the nail clipper in opposite directions above, below, forwardly, rearwardly and laterally thereof for catching and retaining the severed nail fragments and an elongated rod attached to and extending between opposite sides of the collection receptacle and coupled to the forward end portion of the nail clipper.

10 Claims, 1 Drawing Sheet

NAIL CLIPPING AND CATCHING IMPLEMENT AND COLLECTOR ASSEMBLY

BACKGROUND OF THE INVENTION

1. Field of the Invention

The present invention generally relates to a nail clipper and, more particularly, is concerned with a nail clipping and catching implement employing a conventional nail clipper fitted with a collector assembly having a collector assembly which surrounds the forward end portion of the nail clipper for catching and retaining severed or clipped nail fragments.

2. Description of the Prior Art

A conventional nail clipper typically includes a pair of upper and lower spring members being rigidly fastened together at their rear ends and respectively having cutting edges on their front ends which project toward but are spaced from one another. The nail clipper also typically includes a pin extending transversely between and through the spring members immediately rearwardly of their front cutting edges and a cam lever having a forward end inserted and captured under a hook-shaped upper end of the pin protruding above the upper spring member. The cam lever is pivotally retained between the hook-shaped upper end of the pin and the upper surface of the upper spring member. By depressing the cam lever toward the upper spring member, the front ends of the upper and lower spring members and thus the cutting edges thereon are forced toward one another so as to sever an end fragment from a fingernail or toenail placed between the cutting edges of the members.

Upon being cut, the nail fragment typically is ejected rearwardly from the cutting edges and toward the aforementioned pin. The nail fragment frequently hits the pin and ricochets therefrom, scattering from the nail clipper in an unpredictable direction which makes finding and retrieving the nail fragment difficult. As a result, various designs of devices to catch and retain nail fragments at the site of the nail clipper for disposal later have appeared in the prior patent art.

Representative examples of such designs are the ones disclosed in U.S. patents to Lee (U.S. Pat. No. 4,574,475), Grassi (U.S. Pat. No. 4,776,090), Goench (U.S. Pat. No. 5,010,644) and Wagner (U.S. Pat. No. 5,074,041). These designs all have several important drawbacks. The Lee, Goench and Wagner patents propose locating the nail fragment catching receptacle in the limited space between the upper and lower spring members. This drastically limits the holding capacity of the receptacle. The Grassi patent does extend the receptacle to below the lower spring member. However, all designs of these patents requires the introduction of major changes in the constructions of the basic components of the nail clipper which likely makes them too expensive to warrant adoption.

Consequently, a need still exists for a suitable device of relatively low cost for effectively catching and retaining clipped nail fragments.

SUMMARY OF THE INVENTION

The present invention provides a nail clipping and catching implement being designed to satisfy the aforementioned need. The nail clipping and catching implement of the present invention employs the components of the above-described conventional nail clipper which are fitted with a collection receptacle of a collector assembly surrounding a forward end portion of the nail clipper for catching and retaining severed nail fragments. Only very minimal, if any, change needs to be introduced in the components of the conventional nail clipper in order to employ the collector assembly of the present invention with the implement of the present invention.

Accordingly, the present invention is directed to a nail clipping and catching implement for clipping and retaining nail fragments. The nail clipping and catching implement comprises: (a) a nail clipper having a forward end portion defining a pair of cutting edges operable for severing a nail fragment from a fingernail; and (b) a collector assembly having a collection receptacle fitted over a forward end portion of the nail clipper and extending outwardly from and surrounding substantially all sides of the spaced cutting edges for catching and retaining the nail fragments severed by the spaced cutting edges defined on the forward end portion of the nail clipper.

The collection receptacle has a hollow body provided with a rear opening defined therein adapted to receive the forward end portion of the nail clipper therethrough and a front opening defined therein opposite from the rear opening and adapted to receive an end of a finger therethrough for insertion of a tip of the fingernail on the end of the finger between the pair of spaced cutting edges on the forward end portion of the nail clipper. The hollow body of the collection receptacle substantially surrounds the forward end portion of the nail clipper and defines an interior collection chamber extending outwardly from the cutting edges of the forward end portion of the nail clipper in opposite directions above, below, and laterally thereof for catching and retaining nail fragments severed by the cutting edges.

The collector assembly also includes means for securing the collection receptacle to the nail clipper. The securing means includes an elongated rod attached to and extending between opposite sides of the collection receptacle and coupled to the forward end portion of the nail clipper. The elongated rod is attached to and extends between the opposite sides of the collection receptacle and between the forward end portions of a pair of upper and lower spring members of the nail clipper forming the forward end portion thereo. The securing means also includes a fastener removably connected to one of a pair of opposite ends of the elongated rod to detachably attach the one end of the elongated rod to the collection receptacle.

The forward end portion of the nail clipper being surrounded by the collection receptacle also includes a pin having an elongated stem extending transversely between and through the forward end portions of the upper and lower spring members rearwardly from the upper and lower cutting edges thereon. The elongated stem of the pin has a hole defined therethrough. The elongated rod of the collector assembly secures the collection receptacle to the nail clipper by extending through the hole in the elongated stem of the pin and between the forward end portions of the upper and lower spring members defining the forward end portion of the nail clipper.

The present invention is also directed to the above-defined collector assembly used with the nail clipper to catch and retain severed nail fragments.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
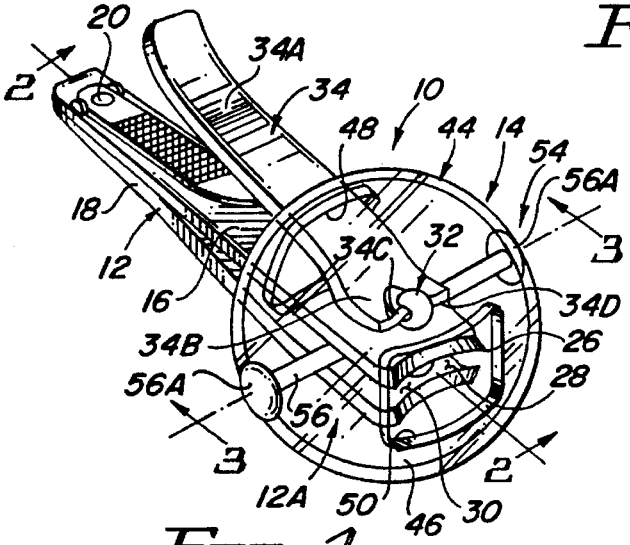
FIG. 1 is a perspective view of a nail clipping and catching implement of the present invention which includes a conventional nail clipper and a collector assembly also of the present invention being applied on a forward end portion of the nail clipper.
Figure 2:
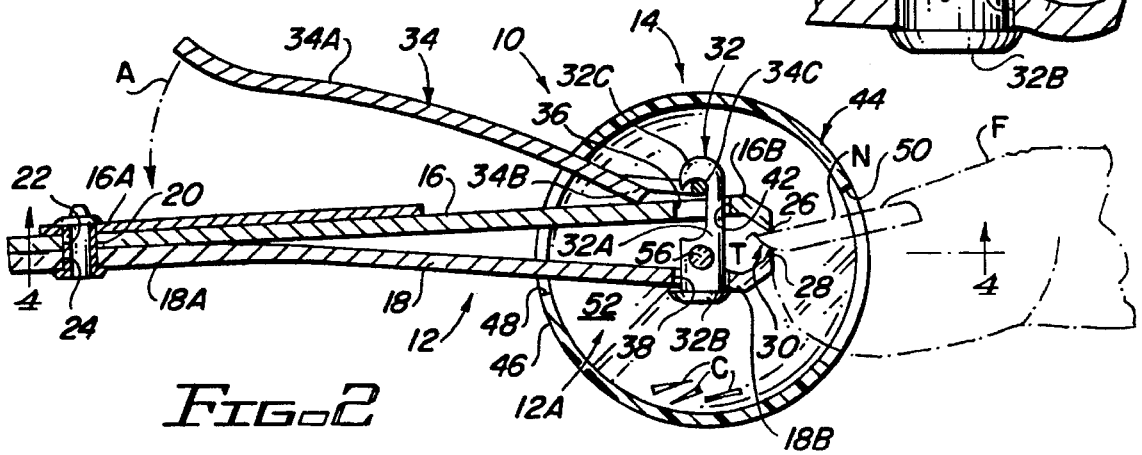
FIG. 2 is an enlarged longitudinal sectional view of the implement taken along line 2—2 of FIG. 1 showing a finger tip extended into a collection receptacle of a collector assembly of the implement.

Referring to the drawings, and particularly to FIGS. 1 and 2, there is illustrated a nail clipping and catching implement 10 comprising one aspect of the present invention. The nail clipping and catching implement 10 basically includes a nail clipper 12, being conventional per se, in combination with a collector assembly 14, comprising another aspect of the present invention, which fits over a forward end portion 12A of the nail clipper 12 and surrounds substantially all sides thereof for catching and retaining severed nail fragments C severed from a fingernail N of a finger F. For the sake of brevity, the term "fingernail" as used hereinafter is meant in a generic sense to include both fingernail and toenail.

Figure 3:
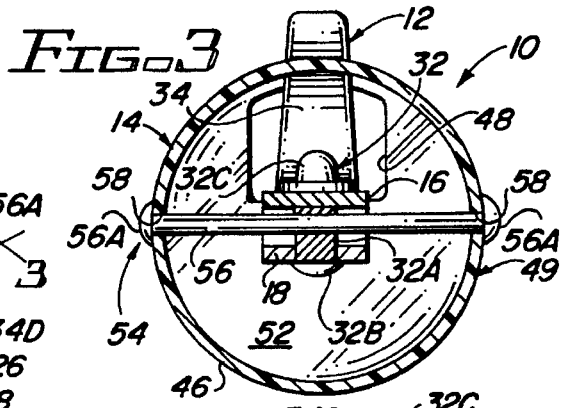
FIG. 3 is an enlarged transverse sectional view of the implement taken along line 3—3 of FIG. 1.
Figure 5:
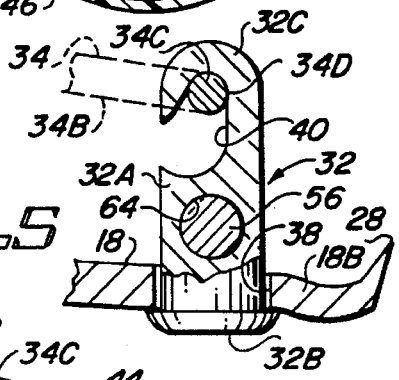
FIG. 5 is an enlarged fragmentary partly sectioned view of a modified pin of the nail clipper of the implement.
Figure 4:
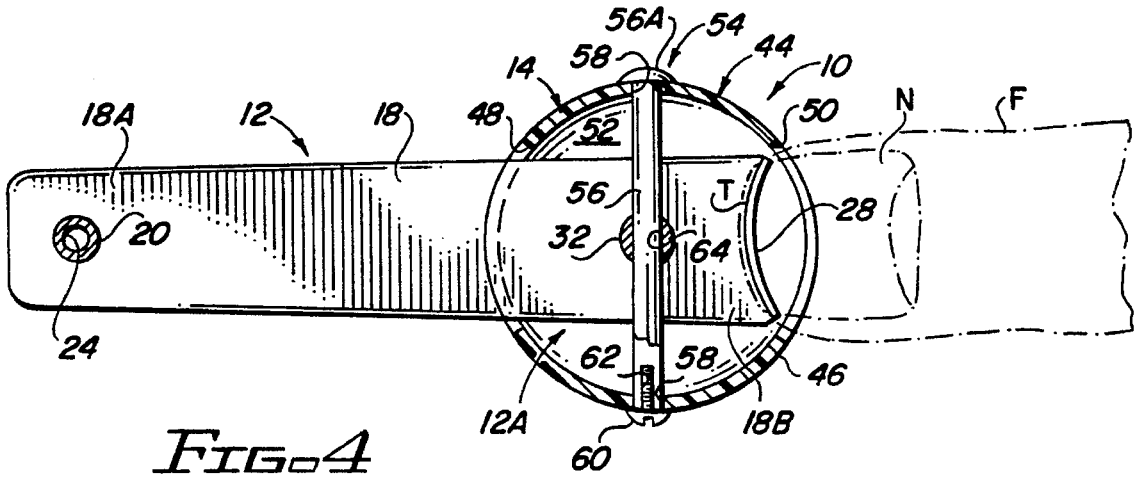
FIG. 4 is an enlarged plan view of the implement, as seen along line 4—4 of FIG. 2.

Referring to FIG. 1, and also to FIGS. 2–4, the conventional nail clipper 12 includes a pair of upper and lower spring members 16, 18 fixedly and rigidly fastened together at their respective rear end portions 16A, 18A by any suitable means, such as a rivet 20, applied through apertures 22, 24 defined in the rear end portions 16A, 18A. The upper and lower spring members 16, 18 also have respective forward end portions 16B, 18B the edges of which are bent to project toward one another and include respective upper and lower cutting edges 26, 28 defined thereon. The upper and lower cutting edges 26, 28 are normally spaced from one another so as to define a gap 30 therebetween through which to insert a fingernail tip T to be clipped or severed. The size of the gap 30 between the upper and lower cutting edges 22, 24 is preset by the amount or degree one or both of the spring members 14, 16 is permanently bent away from the other to form the divergent configuration shown in FIG. 2.

The conventional nail clipper 12 also includes a pin 32 and a cam lever 34 coupled thereto. The pin 32 has an elongated stem 32A extending transversely between the forward end portions 16B, 18B of the upper and lower spring members 16, 18 through respective holes 36, 38 defined therein immediately rearwardly from the upper and lower cutting edges 26, 28 on the upper and lower spring members 16, 18. The pin 32 also has an enlarged head 32B formed on a lower end of the stem 32A which seats against the underside of the lower spring member 18, with the pin 32 inserted from below and upwardly through the respective holes 38, 36 in the forward end portions 18B, 16B of the lower and upper spring members 18, 16. The pin 32 further has a notch 40 defined in an upper half of the stem 32A so as to form an upper hook element 32C on an upper end of the stem 32A. Also, with the pin 32 inserted upwardly through the respective holes 38, 36 in the lower and upper spring members 18, 16, the hook element 32C extends above the upper surface of the forward end portion 16B of the upper spring member 16.

The cam lever 34 has an elongated handle portion 34A and a forward end portion 34B thereon with an aperture 42 defined therethrough. The forward end portion 34B is bent at a slight angle relative to the handle portion 34A such that with the forward end portion 34B of the cam lever 34 resting on the forward end portion 16B of the upper spring member 16, the handle portion 34A extends inclined rearwardly and upwardly at an acute angle relative to the upper spring member 16. The upper hook element 32C of the pin 32 extends upwardly through the aperture 42 in the forward end portion 34B of the cam lever 34 and over a forward segment 34C thereof located between the aperture 42 and terminal edge 34D of the cam lever 34. The forward segment 34C of the cam lever 34 is thereby retained under the hook element 32C between it and the upper surface of the forward end portion 16B of the upper spring member 16 so as to provide a pivotal hinge between cam lever 34 and the upper spring member 16.

By depressing the cam lever 34 in the direction of arrow A (FIG. 2) toward the upper spring member 16, the forward end portions 16B, 18B of the upper and lower spring members 16, 18 and thus the upper and lower cutting edges 26, 28 thereon are forced to move toward one another so as to sever a nail fragment C from the tip T of the fingernail N inserted between the cutting edges 26, 28 of the upper and lower spring members 16, 18. Upon being cut from the fingernail N, the nail fragment C is typically ejected rearwardly from the cutting edges 26, 28 of the nail clipper 12 toward the pin 32. The nail fragment C frequently hits the stem 32A of the pin 32 and ricochets therefrom, scattering from the nail clipper 12 in any one of many directions therefrom making the finding and retrieving of the nail fragment C very difficult. The collector assembly 14 of the nail clipping and catching implement 10 is designed and intended to catch and retain the severed nail fragments C at the site of the nail clipper 12 for disposal later.

Referring again to FIGS. 1–4, the collector assembly 14 used with the nail clipper 12 includes a collection receptacle 44 fitted over the forward end portion 12A of the nail clipper 12 and extending outwardly from and surrounding substantially all sides of the spaced cutting edges 26, 28 defined on the forward end portion 12A of the nail clipper 12 for catching and retaining the nail fragments C severed by the spaced cutting edges 26, 28.

The collection receptacle 44 has a hollow body 46, for example, being spherical in configuration and made of transparent material such as a suitable plastic material. Also, the hollow body 46 can be provided in other configurations and can be made of non-transparent materials. The hollow body 46 is provided with a rear opening 48 defined therein adapted to receive the forward end portion 12A of the nail clipper 12 therethrough and a front opening 50 defined therein opposite from the rear opening 48 and adapted to receive the end of the finger F therethrough, as seen in FIGS. 2 and 4, for insertion of a tip T of the fingernail N on the end of the finger F between the pair of spaced cutting edges 26, 28 on the forward end portion 12A of the nail clipper 12. The hollow body 46 of the collection receptacle 44 substantially surrounds the forward end portion 12A of the nail clipper 12 and defines an interior collection chamber 52 extending outwardly from the cutting edges 26, 28 of the forward end portion 12A of the nail clipper 12 in all opposite directions above, below, rearwardly, forwardly and laterally thereof for catching and retaining nail fragments N severed by the cutting edges 26, 28.

Referring to FIGS. 1–5, the collector assembly 14 also includes means 54 for securing the hollow body 46 of the collection receptacle 44 to the nail clipper 12. The securing means 54 includes an elongated rigid rod 56 attached to and extending between opposite sides of the hollow body 46 and coupled to the forward end portion 12A of the nail clipper 12. For example, the elongated rod 56 extends through apertures 58 defined in aligned relation to each other in the opposite sides of the hollow body 46 of the collection receptacle 44. Flat heads 56A are formed on opposite ends of the rod 56 for retaining it through the apertures 58. Alternatively, as shown in FIG. 4, the securing means 54 can also include a screw fastener 60 threadably connected to one of the opposite ends of the elongated rod 56 via a threaded hole 62 tapped therein. By unscrewing the fastener 60 from the hole 62, the rod 56 can be detached or removed allowing the collection receptacle 44 to be removed from or inserted over the forward end portion 12A of the nail clipper 12.

The elongated rod 56 is employed to couple the collector assembly 14 between the forward end portions 16B, 18B of the upper and lower spring members 16, 18 of the nail clipper 12 forming the forward end portion 12A thereof. Preferably, although not necessarily, as seen in FIGS. 2–5, the elongated rod 56 extends through a hole 64 defined transversely through the elongated stem 32A of the pin 32 extending transversely between and mounted through the respective holes 36, 38 in the forward end portions 16B, 18B of the upper and lower spring members 16, 18 located immediately rearwardly from the upper and lower cutting edges 26, 28 thereon. The hole 64 is located between the notch 40 defined in the stem 32A and the head 32B on the lower end of the pin 32.

The elongated rod 56 of the collector assembly 14 thus preferably secures the collection receptacle 44 to the nail clipper 12 by extending through the hole 64 in the elongated stem 32A of the pin 32. An alternate, though less desirable, way to secure the collection receptacle 44 to the nail clipper 12 is merely to provide the elongated rod 56 extending between the forward end portions 16B, 18B of the upper and lower spring members 16, 18 either rearwardly or forwardly of the pin 32.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

I claim:

1. A nail clipping and catching implement, comprising:

(a) a nail clipper having a forward end portion defining a pair of upper and lower spaced cutting edges operable for severing a nail fragment from a fingernail; and (b) a collector assembly having a collection receptacle fitted over said forward end portion of said nail clipper and surrounding and extending outwardly from substantially all sides of said pair of upper and lower spaced cutting edges for catching and retaining nail fragments severed by said pair of upper and lower spaced cutting edges defined on said forward end portion of said nail clipperl (c) said forward end portion of said nail clipper being surrounded by said collection receptacle including respective forward end portions of a pair upper and lower spring members having defined thereon respective ones of said upper and lower spaced cutting edges;

(d) said collector assembly also including means for securing said collection receptacle to said nail clipper, said securing means including an elongated rod attached to and extending between opposite sides of said collection receptacle and between said forward end portions of said upper and lower spring members;

(e) said forward end portion of said nail clipper surrounded by said collection receptacle also including a having an elongated stem extending transversely between and through said forward end portions of said upper and lower spring members rearwardly from said pair of upper and lower cutting edges thereon, said elongated stem of said pin has a hole defined therethrough, said elongated rod extending through said hole in said elongated stem of said pin.

2. The implement of claim 1 wherein said securing means also includes a fastener removably connected to one of a pair of opposite ends of said elongated rod to detachably attach said one end of said elongated rod to said collection receptacle.

3. The implement of claim 1 wherein said securing means also includes a fastener removably connected to one of a pair of opposite ends of said elongated rod to detachably attach said one end of said elongated rod to said collection receptacle.

4. The implement of claim 1 wherein said nail clipper also includes a cam lever having a forward end portion thereon disposed within said collection receptacle resting on said forward end portion of said upper spring member and pivotally hinged to an upper end of said pin extending above said forward end portion of said upper spring member, said cam lever also including an elongated handle portion connected to said forward end portion of said cam lever and extending rearwardly from said collection receptacle.

5. The implement of claim 1 where said collection receptacle has a hollow body provided with a rear opening defined therein adapted to receive said forward end portion of said nail clipper therethrough and a front opening defined therein opposite from said rear opening and adapted to receive an end of a finger therethrough for insertion of a tip of a fingernail on the end of the finger between said pair of upper and lower spaced cutting edges on said forward end portion of said nail clipper.

6. The implement of claim 5 wherein said hollow body of said collection receptacle substantially surrounds said forward end portion of said nail clipper and defines an interior collection chamber extending outwardly from said cutting edges of said forward end portion of said nail clipper in opposite directions above, below, rearwardly, forwardly and laterally thereof for catching and retaining nail fragments severed by said cutting edges of said forward end portion of said nail clipper.

7. The implement of claim 1 wherein said collection receptacle has a hollow body which is substantially transparent.

8. The implement of claim 1 wherein said collector assembly also includes means for securing said collection receptacle to said nail clipper.

9. The implement of claim 8 wherein said securing means includes an elongated rod attached to and extending between opposite sides of said collection receptacle and coupled to said forward end portion of said nail clipper.

10. The implement of claim 9 wherein said securing means also includes a fastener removably connected to one of a pair of opposite ends of said elongated rod to detachably attach said one end of said elongated rod to said collection receptacle.

* * * * *